US005108272A

United States Patent [19]

Brewer et al.

[11] Patent Number: 5,108,272

[45] Date of Patent: Apr. 28, 1992

[54] SUCKER ROD PUMP

[75] Inventors: James R. Brewer, Bakersfield, Calif.; Wayne D. Lentz, Calgary, Canada

[73] Assignees: Shell Western E & P Inc., Houston, Tex.; Shell Canada Limited, Alberta, Canada

[21] Appl. No.: 661,368

[22] Filed: Feb. 27, 1991

[51] Int. Cl.[5] ..... F04B 7/04; F04B 21/02

[52] U.S. Cl. ..... 417/520; 417/559; 417/569

[58] Field of Search ..... 417/559, 448, 511, 520, 417/443, 449, 450, 569, 570; 137/527.8, 512.1

[56] References Cited

U.S. PATENT DOCUMENTS

| | | | |
|---|---|---|---|
| 252,643 | 1/1882 | Bartlett | 417/443 |
| 346,206 | 7/1886 | Jensen | 417/559 |
| 1,353,391 | 9/1920 | Hall | 417/448 |
| 1,493,267 | 5/1924 | Kauffmann | 417/520 |
| 1,823,936 | 9/1931 | Harper | 417/443 |
| 1,832,995 | 11/1931 | Ogletree | 417/443 |
| 4,502,503 | 3/1985 | Kardenko | 137/527.8 |

*Primary Examiner*—Richard A. Bertsch
*Assistant Examiner*—Peter Korytnyk

[57] ABSTRACT

A subsurface well pump is provided which is resistant to vapor locking. The pump is a reciprocating sucker rod pump which has a top inlet valve, and a means to vent vapors from the barrel of the pump on each stroke.

12 Claims, 2 Drawing Sheets

FIG. 3
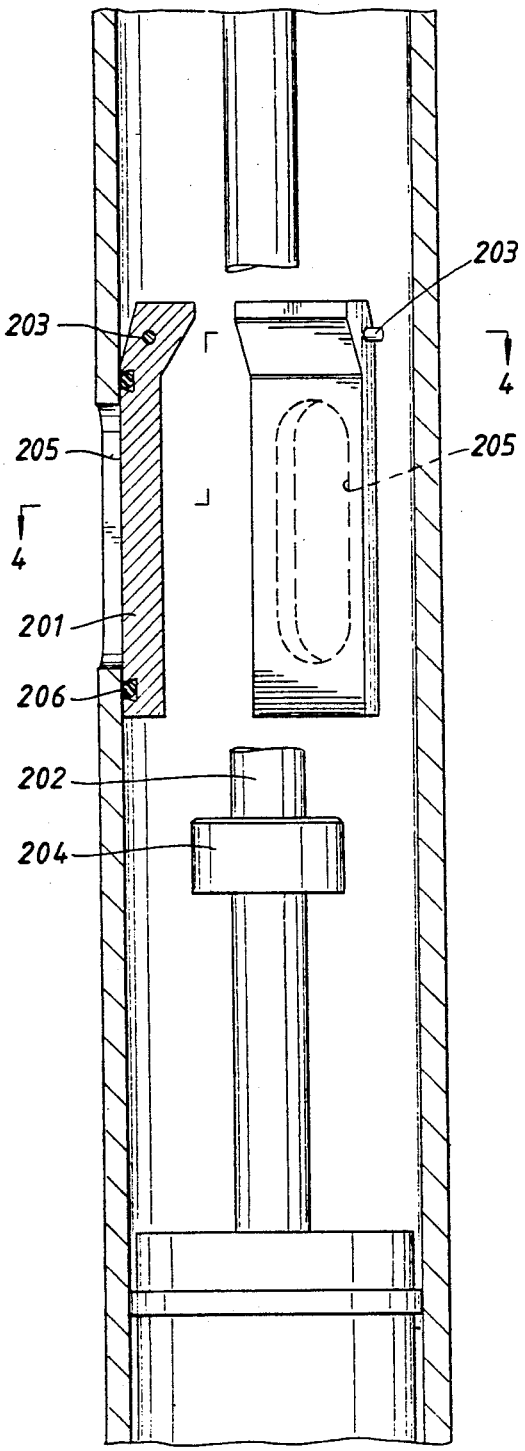
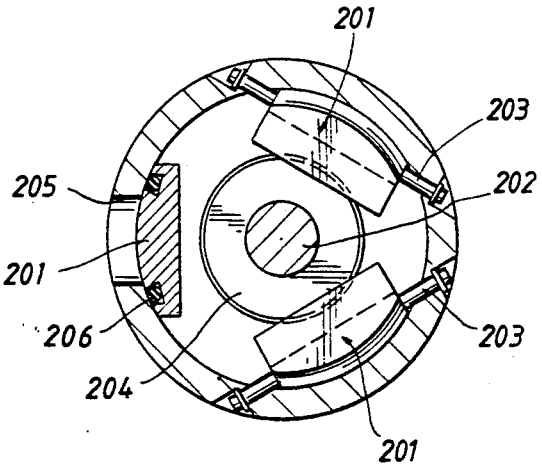
FIG. 4

SUCKER ROD PUMP

FIELD OF THE INVENTION

This invention relates to an improved sucker rod pump.

BACKGROUND OF THE INVENTION

Sucker rod pumps are positive displacement pumps used to pump hydrocarbons and other liquids from wells. These pumps are located in the well bore below the liquid level of the liquid to be pumped. The pump has a barrel within which a piston slides up and down. The piston is moved by a rod which extends to the surface, where it is moved up and down by a surface-located pumping unit. The barrel has an inlet check valve at the bottom of the barrel and an outlet check valve in the piston. Fluids flow from the top of the barrel, via the outlet check valve, to a tubing which extends to the surface. When the piston slides down, fluids are forced through the outlet check valve in the piston, with the inlet check valve at the bottom of the barrel seating. When the piston is stroking upward, the check valve on the piston seals, and the fluids within the barrel above the piston are lifted upward, into the tubing which extends to the surface. At the same time, the piston draws fluids into the barrel through the inlet check valve. These pumps have proven to be simple and reliable although not without shortcomings. When fluids which are near their flash point temperature are being pumped, they will partially vaporize when they are drawn into the barrel. Any vapor which is drawn into the barrel must be compressed to the pressure of the discharge tubing before the top check valve will open. The volume of vapors within the pump can be great enough that the full stroke of the piston will not achieve a sufficient pressure to force the outlet check valve open. When this happens, the pump is in a state referred to as vapor locked. When the fluid being pumped has a considerable amount of dissolved light material, the pump will be subject to vapor locking. When an oil field is subject to a steam flood, producing wells will contain a mixture of oil and condensate near its flashing point. This fluid can also cause sucker rod pumps to vapor lock.

When a sucker rod pump is vapor locked, it is typically shut down for a period to break the vapor lock. During this period, vapors will have a chance to escape through check valves, and the pump can cool due to the absence of the heat of compression. The vapor lock will eventually break, and pumping can then be continued. Less patient operators adjust the length of the rod, allowing the piston to bang against the ends of the barrel. This causes the outlet and/or the inlet valve to unseat and break the vapor lock. Neither of these solutions to the problem of vapor locking sucker rod pumps is acceptable.

Pumps have been developed which are less prone to vapor locking, but these pumps each have shortcomings. One such pump is described in U.S. Pat. No. 4,221,551. This pump has two sliding valves, both within a barrel, and above a plunger. When the plunger is moving downward, both valves are in lower positions. In the lower position, the bottom valve (inlet valve) has ports aligned with ports in the barrel providing communication between the well borehole and the pump barrel. The top sliding valve (outlet valve) functions like a check valve, sliding upward when the barrel pressure exceeds the pressure at the bottom of the well string. When slid to its upper position, the top valve has ports which align with ports in the barrel to provide communication between the barrel and the well string. When the lower sliding valve (inlet valve) is moved to an upper position, the ports are not aligned. The lower valve is an inverted cup configuration with inlet ports or a sleeve, and shoulder ports on the top to allow fluids to communicate from the lower position of the barrel to the top sliding valve. The lower valve is moved to the upper position by the pressure differential created by flow being forced through shoulder ports. Therein lies the shortcoming of this design. There is no significant flow through these shoulder ports until the pressure within the barrel exceeds the pressure at the bottom of the well string, opening the outlet valve. The bottom valve will therefore not move until the top valve opens. Pressure within the barrel must build as a result of the rising plunger in spite of the inlet valve remaining open. This dictates that the inlet ports must have small flow areas because large ports would result in the plunger forcing flow in and out of the working barrel through the inlet ports without ever achieving a pressure sufficiently high to open the outlet valve. The small size of the inlet ports ensures that flashing will occur when fluids near their bubble points are pumped. The mechanism of closing the inlet valve ensures that a significant portion of the upward stroke of the pump will not be productive due to fluids exiting the barrel through the inlet valve ports. This design therefore has many shortcomings.

Another sucker rod pump design which is said to prevent vapor locking is described in U.S. Pat. No. 3,046,904. This design also has inlet and outlet valves above a plunger. This pump utilizes about 24 small ball check valves as inlet valves, all located in an inlet shroud around the top of the working barrel. The small inlet check valves of this design, again, assure that some flashing will occur when fluids near their bubble points are pumped. Further, if sufficient vapors get into the pump barrel, the pump will, in fact, vapor lock. There is no mechanism to release vapors from the barrel other than to compress them and force them up the well string. If the plunger stroke does not compress vapors within the barrel to the pressure of the bottom of the well string, a vapor lock will result. This design therefore does not solve the problem of preventing vapor lock of sucker rod pumps.

Another subsurface pump which is said to avoid vapor locking is described in U.S. Pat. No. 3,136,256. This pump avoids vapor lock by mechanically lifting a standing valve ball (intake valve) near the top of the intake stroke of the pump. This design has the inlet valve in the typical bottom position. What is vented is therefore the volume which is least likely to have a large amount of vapor. The timing of the opening of the valve is also undesirable. Opening the valve at the end of the inlet stroke almost ensures that the stroke will not result in fluids being pumped up the well string. Opening the valve at the end of the inlet stroke also vents the barrel at the lowest possible barrel pressure. At this pressure, because of the limited time available for venting the vapor locked barrel and then replacing the vapor with pumpable liquids, there will be very little driving force to expel compressed vapors. It is unlikely that venting the barrel at this point in the pumping stroke will even break a vapor lock because breaking the vapor lock not only requires that the excess pressure be vented, but that liquids flow into the barrel to be pumped on the downstroke. Both venting the barrel and filling a significant portion of the barrel with pumpable fluids is not likely to be achieved by merely opening the inlet valve at the top of the inlet stroke.

It is therefore an object of the present invention to provide a well pump which is capable of pumping volatile fluids and is resistant to vapor locking. It is a further object of the present invention to provide a deep well pump which is of a simple design with relatively few moving parts and relatively few sealing surfaces. It is a further object to provide a deep well pump having one or more inlet valves which has a very low pressure drop through the inlet valve. It is another object of this invention to provide a well pump which will not fluid pound.

SUMMARY OF THE INVENTION

The objectives of the present invention are achieved by providing a subsurface well pump, the pump comprising:

- a working barrel;
- a plunger which reciprocates within the working barrel from a top position to a bottom position;
- a rod connected to the plunger and extending to a means for providing reciprocating force;
- a well string extending from the top end of the working barrel to the surface;
- an outlet check valve which permits flow to exit the working barrel into the well string and does not permit flow to exit the well string into the working barrel; and
- an inlet check valve which permits fluids to flow from outside of the working barrel into the working barrel, the inlet check valve being above the top position of the plunger, the inlet check valve having a cross sectional area of flow about equal to or greater than the horizontal cross sectional area of the working barrel, and a means to mechanically open the inlet check valve when the plunger is near the top position.

The pump of this invention will be resistant to vapor locking, and will break a vapor lock if one develops due to a combination of features which include a top inlet valve, a low pressure drop through the inlet valve, and the mechanical opening of the inlet valves. The mechanical opening may be movement of a slide valve or a mechanical lifting of flapper or ball valves, or other mechanical means.

In a preferred embodiment, the "dead volume", or the volume of compressed fluids between the outlet check valve and the plunger at its uppermost position, is minimized. This increases the pressure which is attained by the reciprocating pump when the working cylinder is partially filled with vapors.

BRIEF DESCRIPTION OF THE DRAWINGS

FIG. 3 is a vertical cutaway cross sectional view of an embodiment of this invention utilizing flapper valves.

FIG. 4 is a horizontal cutaway cross sectional view of an embodiment of this invention utilizing flapper valves.

DETAILED DESCRIPTION OF THE INVENTION

Figure 1:
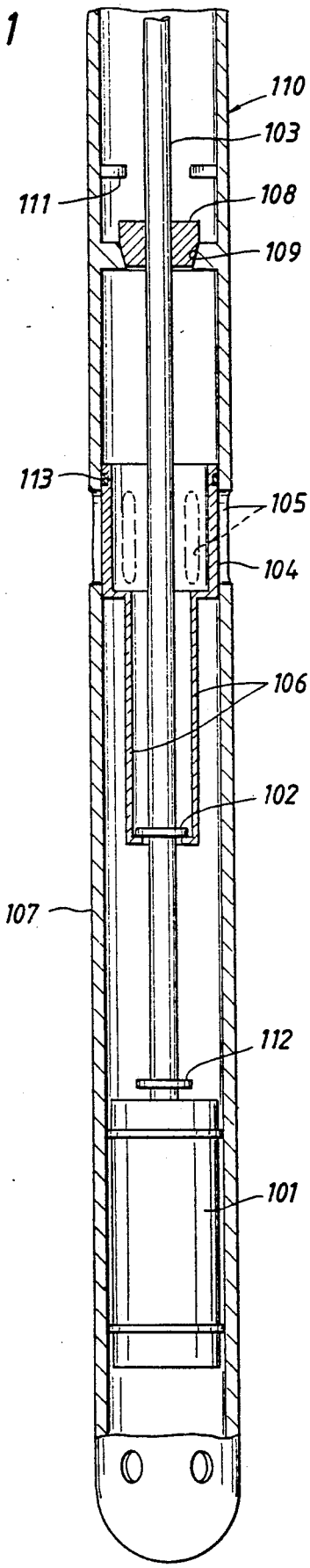
FIG. 1 is a vertical cutaway cross sectional view of one embodiment of this invention with the plunger in the lower position.

FIG. 1 shows a sucker rod pump of the present invention in which the plunger, 101, is in the lower most position. In this position, an inlet valve closing ring, 102, which is affixed to a reciprocating rod, 103, has just moved a sliding inlet valve, 104, into a position in which it covers inlet valve ports, 105. In the embodiment shown, the inlet valve closing ring moves the inlet valve by contacting inlet valve legs, 106.

As the plunger, 101, is pulled upward by the rod, 103, fluids within the working barrel, 107, are forced out of the working barrel through an outlet valve, 108. The outlet valve shown slides freely over the rod, 103, but seals against the rod. The outlet valve rests on an outlet valve seat, 109, when in the closed position, preventing flow from backing down the well string, 110, into the working barrel, 107. When the plunger is moving upward, fluids within the working barrel force the outlet valve upward and against a retaining cage, 111. Near the top of the plunger stroke, inlet valve opening ring, 112, will force the sliding inlet valve, 104, into a position which exposes the inlet valve ports, 105. Because the pressure outside of the inlet valve ports is less than the pressure in the well string, 110, above the outlet valve, 108, the outlet valve, 108, will settle onto the outlet valve seat, 109, as the sliding inlet valve uncovers the inlet ports, 105.

The inlet ports, 105, must have a flow area that is sufficiently large to minimize flashing of fluids being drawn into the barrel. A flow area equal to the horizontal cross sectional area of the working barrel will generally be sufficient, although a larger flow area is preferred.

Figure 2:
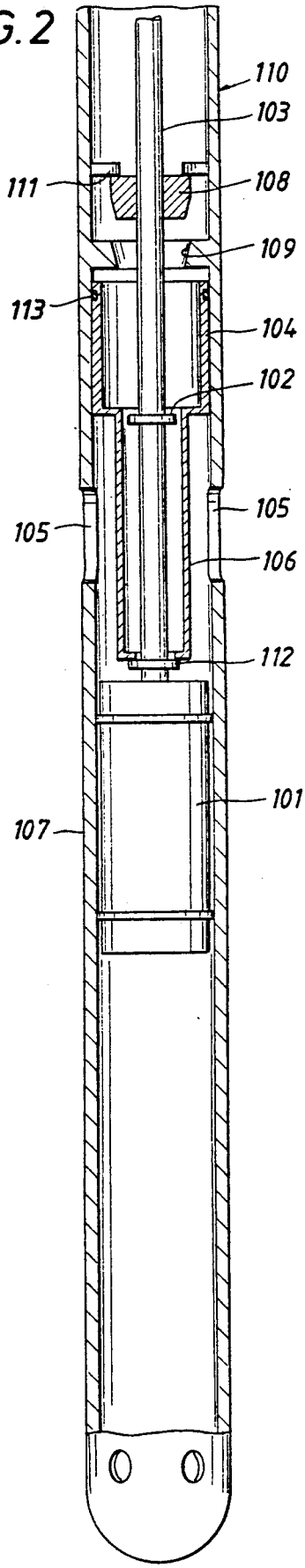
FIG. 2 is a vertical cutaway cross sectional view of one embodiment of this invention with the plunger in the upper position.

FIG. 2 shows the same pump with the plunger, 101, at an uppermost position. In this position, the inlet valve opening ring, 112, has moved the sliding inlet valve, 104, to a position which uncovers the inlet valve ports, 105. A friction ring, 113, attached to the inlet sliding valve, keeps the inlet sliding valve in the position it is last positioned in by either the inlet valve opening ring, 112, or the inlet valve closing ring, 102.

It is therefore a feature of this preferred embodiment that the inlet valve is opened at the end of the compression stroke by direct mechanical action of the rod. This pump therefore does not rely on the pressure within the working barrel being less than the pressure surrounding the pump for the inlet valve to open. A vapor lock will therefore be broken by expelling pressured fluids prior to the start of the inlet stroke, allowing fluids to then be drawn into the pump by the rest of the plunger's down stroke.

The location of the inlet ports at the top of the working barrel maximizes the venting of vapor rich working barrel contents when the pump has vapor locked.

Inlet valves of another preferred embodiment are shown in FIG. 3. These inlet valves are located above the upper position of the plunger within the working barrel, and below the outlet valve. Three hinged valves may be provided although the number of valves is not critical. In FIG. 3, inlet valves are shown, 201, pivoting on hinge pins, 203. The top of the hinge valve is bent toward the centerline of the pump in order to provide a neutral balance position which presses the hinge valve against the wall of the valve section to cover inlet ports, 205. The reciprocating rod, 202, must pass through the vertical centerline of this section of the sucker rod pump so the valves must provide clearance for this rod. The feature of opening the inlet valve is accomplished by providing a collar, 204, around the rod at a distance above the plunger such that the collar forces the counterbalance tabs of the hinged valves near the top of the compression stroke. The collar is long enough to ensure that the counterbalance tabs do not slide under the collar, and be trapped when the reciprocating rod travels downward.

The seal between the flapper and the wall surrounding the inlet port may optionally be improved by inserting a seal ring in a groove in either the flapper or the wall of the barrel. FIG. 3 displays such a seal ring, 206, in the flapper within a groove surrounding the inlet inlet port.

A large inlet port flow area can be provided with this inlet port design. This large inlet port flow area and the location of the inlet valve at the top of the upper stroke of the plunger minimizes the pressure drop caused by drawing fluids into the pump.

The embodiment of FIG. 3 further has the desirable features of permitting a very small volume between the top of the plunger in the uppermost position and the outlet valve. Having this volume as small as possible results in maximum compression of any vapors within the working barrel. A relatively high fraction of the volume within the working barrel must therefore be vapor in order for the pump to vapor lock.

FIG. 4 displays a horizontal cross section of the flapper valves of the pump of FIG. 3. Flappers, 201, with optional seal ring, 206, are shown in the closed position. In the closed position, inlet ports, 205, are covered and sealed. The rod, 202, is shown passing through the center of the pump, with a collar, 204, for opening the flappers by contacting the tabs which extend toward the pump centerline. These tabs are contacted from underneath, near the top of the plunger stroke. Pins, 203, are shown extending through the wall of the working barrel to provide pivotable securing of the flapper valves.

The pumps of the present invention, due to the location of the inlet valve above the plunger, do not allow fluid pounding, because fluid is being lifted by the plunger, and not forced through a travelling valve in the plunger as in a conventional sucker rod pump.

What is claimed is:

1. A subsurface well pump comprising:

a) a working barrel;

b) a plunger which reciprocates within the working barrel between an upper and a lower position;

c) a rod connected to the plunger and extending to a means for providing reciprocating force;

d) a well string extending from the top of the working barrel to the surface;

e) an outlet check valve which permits flow to exit the working barrel into the well string and does not permit flow to exit the well string into the working barrel; and f) an inlet check valve which permits flow into the working barrel from outside of the subsurface pump, the check valve being above the top position of the plunger, and the inlet check valve having a cross sectional flow area about equal to or greater than the horizontal cross sectional area of the working barrel, and a means to mechanically open the inlet check valve when the plunger is near the top position.

2. The pump of claim 1 wherein the inlet valve is a hinged flapper valve.

3. The pump of claim 1 wherein the inlet valve is a sliding valve which is forced to a position which covers inlet ports when the plunger is near its lower position and forced to a position which uncovers the inlet ports when the plunger is near its upper position by contact with a ring which is fixed to the plunger or to the rod.

4. The pump of claim 3 wherein the sliding valve is forced into each position by protrusions from the rod which contact rings connected to the sliding valve.

5. The pump of claim 1 wherein the inlet valve comprises hinged flappers which cover ports in a closed position, and which freely swing away from the ports to open when not being mechanically opened.

6. The pump of claim 5 wherein the flappers are hinged at the top, and have counter balance tabs which extend toward the centerline of the pump barrel.

7. The pump of claim 6 wherein a collar is attached to the rod which contacts the balance tabs when the plunger is near its upper position, thereby forcing the flappers at least partially open.

8. The pump of claim 4 wherein the outlet valve is a sliding ring valve.

9. The pump of claim 7 wherein the outlet valve is a sliding ring valve.

10. The pump of claim 4 wherein the sliding valve comprises a friction ring which holds the valve in the position to which it was last moved.

11. The pump of claim 10 in which the sliding valve further comprises legs which extend toward the centerline of the pump and two rings which, are attached to the rod in positions in which one ring contacts the legs and forces the sliding valve to uncover the inlet ports near the top position of the plunger and the other ring contacts the legs and forces the sliding valve to cover the inlet ports near the bottom position of the plunger.

12. The pump of claim 11 wherein the top surface of the plunger also is the ring which forces open the inlet valve.

* * * * *